US009321576B2

(12) United States Patent
Shi

(10) Patent No.: US 9,321,576 B2
(45) Date of Patent: Apr. 26, 2016

(54) PACKAGING DEVICE FOR LIQUID CRYSTAL MODULES

(71) Applicant: Shenzhen China Star Optoelectronics Technology Co., Ltd., Shenzhen, Guangdong (CN)

(72) Inventor: Qinjun Shi, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 252 days.

(21) Appl. No.: 13/824,400

(22) PCT Filed: Jan. 17, 2013

(86) PCT No.: PCT/CN2013/070574
§ 371 (c)(1),
(2) Date: Mar. 18, 2013

(87) PCT Pub. No.: WO2014/106359
PCT Pub. Date: Jul. 10, 2014

(65) Prior Publication Data

US 2014/0190867 A1 Jul. 10, 2014

(51) Int. Cl.

| | |
|---|---|
| ***B65D 85/00*** | (2006.01) |
| ***A47G 19/08*** | (2006.01) |
| ***B65D 81/113*** | (2006.01) |
| ***B65D 19/44*** | (2006.01) |
| ***B65D 81/05*** | (2006.01) |

(52) U.S. Cl.
CPC ..... *B65D 81/113* (2013.01); *B65D 19/44* (2013.01); *B65D 81/055* (2013.01); *B65D 2519/00159* (2013.01); *B65D 2519/00194* (2013.01); *B65D 2519/00502* (2013.01); *B65D 2519/00621* (2013.01); *B65D 2519/00661* (2013.01); *B65D 2519/00815* (2013.01); *B65D 2585/6837* (2013.01)

(58) Field of Classification Search
CPC ..... B65D 77/00; B65D 81/05; B65D 85/30
USPC ..... 206/320, 386, 454, 521, 521.2, 523, 206/586, 701, 722; 211/320, 41.14; 248/231.91, 125.8; 349/58
See application file for complete search history.

(56) References Cited

U.S. PATENT DOCUMENTS

| | | | | |
|---|---|---|---|---|
| 3,709,358 | A * | 1/1973 | Andrews et al. | 206/451 |
| 4,403,694 | A * | 9/1983 | Schmale | 206/347 |
| 5,398,808 | A * | 3/1995 | Chen et al. | 206/320 |
| 5,497,939 | A * | 3/1996 | Heiskell et al. | 229/122.24 |
| 5,620,243 | A * | 4/1997 | Billingham | 312/259 |
| 5,676,066 | A * | 10/1997 | Cavalier et al. | 108/55.1 |
| 5,850,924 | A * | 12/1998 | Borter | 211/41.14 |
| 5,859,762 | A * | 1/1999 | Clark et al. | 361/679.41 |
| 6,302,034 | B1 * | 10/2001 | Swanson | 108/55.1 |

(Continued)

*Primary Examiner* — Anthony Stashick
*Assistant Examiner* — Kaushikkumar Desai

(57) ABSTRACT

A packaging device for liquid crystal modules is provided, comprising a bracket installed at the bottom of the liquid crystal module, a pallet carried by a supporting member and used for fixing the bracket, a protective layer arranged on all sides of the liquid crystal module for fixing and buffering, and a packaging box arranged outside the protective layer for packaging. The packaging device for liquid crystal modules of the present invention ensures the transport safety, facilitates the manual packaging and transporting, and reduces the entire packaging weight.

10 Claims, 7 Drawing Sheets

(56) References Cited

U.S. PATENT DOCUMENTS

| | | | | |
|---|---|---|---|---|
| 6,517,134 | B2 * | 2/2003 | Armstrong | 296/3 |
| 6,966,532 | B2 * | 11/2005 | Ishizaki et al. | 248/274.1 |
| 8,181,796 | B2 * | 5/2012 | DiFazio et al. | 211/41.14 |
| 8,403,142 | B2 * | 3/2013 | Rose et al. | 206/448 |
| 2001/0027932 | A1 * | 10/2001 | Arima | 206/523 |
| 2005/0045512 | A1 * | 3/2005 | Carroll | 206/454 |
| 2006/0113214 | A1 * | 6/2006 | Shimizu et al. | 206/576 |
| 2006/0219596 | A1 * | 10/2006 | Lin et al. | 206/592 |
| 2006/0226046 | A1 * | 10/2006 | Matsumoto et al. | 206/597 |
| 2007/0131574 | A1 * | 6/2007 | Aoki | 206/454 |
| 2007/0145212 | A1 * | 6/2007 | Yamanaka | 248/176.1 |
| 2008/0112115 | A1 * | 5/2008 | Yang | 361/681 |
| 2009/0065385 | A1 * | 3/2009 | Kakuta et al. | 206/316.1 |
| 2012/0211396 | A1 * | 8/2012 | Asanuma | 206/701 |

* cited by examiner

PACKAGING DEVICE FOR LIQUID CRYSTAL MODULES

FIELD OF THE INVENTION

The present invention relates to the field of packaging, especially to a packaging device for liquid crystal modules.

BACKGROUND OF THE INVENTION

The internal structure of a current liquid crystal module mainly includes a display screen and a backlight component, wherein the two portions are assembled as a whole for packaging and transporting. Due to the large size and weight, the large-sized liquid crystal module only can be packaged as a whole for transportation with the help of a mechanical lifting device. However, manual operation is still needed for transporting, packaging and unpackaging, and it is very difficult to manually transport and unpackage the liquid crystal module that is packaged as a whole for transportation.

CONTENTS OF THE INVENTION

The object of the present invention is to provide a packaging device applicable to a large-sized liquid crystal module, so as to overcome the defect of the hard transporting and unpackaging for the large-sized liquid crystal module that is packaged as a whole for transportation.

In order to solve the technical problem, the following technical solution is provided in the present invention:

According to one aspect of the present invention, a packaging device for liquid crystal modules is provided, comprising a bracket installed at the bottom of the liquid crystal module, a pallet carried by a supporting member and used for fixing the bracket, a protective layer arranged on all sides of the liquid crystal module for fixing and buffering, and a packaging box arranged outside the protective layer for packaging.

Preferably, the bracket is an L-shaped bracket.

Preferably, the packaging device for liquid crystal modules further includes a buffer gasket arranged between the supporting member and the bracket for buffering.

Preferably, the supporting member for buffering and positioning includes a bulge used for positioning the bracket.

Preferably, the bracket is fixed to the pallet through a bolt.

Preferably, the protective layer includes a lower foaming buffer layer arranged at the bottom of the liquid crystal module, a lateral foaming buffer layer arranged at both sides of the liquid crystal module, and an upper foaming buffer layer arranged at the top of the liquid crystal module.

Preferably, the packaging box is made of corrugated paper.

Preferably, the packaging box includes two pieces of outer cartons spliced together and a top carton closely covering their top.

Preferably, the packaging device for liquid crystal modules further includes a lock catch for fixing the two pieces of outer cartons together.

Preferably, the packaging device for liquid crystal modules further includes a plurality of packaging belts for fixing the packaging box and the pallets together.

The packaging device for liquid crystal modules of the present invention has the following advantages or beneficial effects: The packaging device for liquid crystal modules of the present invention ensures the transport safety, facilitates the manual packaging and transporting, and reduces the entire packaging weight.

BRIEF DESCRIPTIONS OF THE DRAWINGS

In order to explain the technical solutions of the examples of the present invention more clearly, the drawings needing to be used in the examples will be described briefly in the following. Obviously, the drawings below are only some examples of the present invention, according to which those of ordinary skill in the art can also obtain other drawings without an inventive effort. In the drawings.

DETAILED DESCRIPTION OF THE EMBODIMENTS

In order to make the purpose, technical solutions and advantages of the present invention clearer and more understandable, various examples will be described below with reference to the corresponding drawings, which constitute a part of the examples, with various examples possible to be used for realizing the present invention being described here. It should be understood that other examples can also be used, or the examples enumerated here can be amended in structure and function and will not depart from the scope and spirit of the present invention.

The packaging device for liquid crystal modules of the present invention is used for packaging a large-sized liquid crystal module, and facilitates manual transporting, packaging and unpacking without the cooperation of a mechanical labor-saving device.

As shown in FIGS. 1-9, an example of the packaging device for liquid crystal modules provided by the present invention is used for packaging a liquid crystal module 2, which can be any existing large-sized liquid crystal module. The example of the packaging device for liquid crystal modules includes a bracket 1 installed at the bottom of the liquid crystal module 2, a pallet 3 carried by a supporting member and used for fixing the bracket 1, a protective layer arranged on all sides of the liquid crystal module 2 for fixing and buffering the same, and a packaging box arranged outside the protective layer for packaging. The main technical solution of the present invention is to install the auxiliary bracket 1 at the bottom of the liquid crystal module 2 so as to make the liquid crystal module 2 easy to be transported and packaged, and to fix the liquid crystal module 2 to the supporting pallet 2 through the bracket 1, with the bracket 1 fixed to the pallet 3 preferably through a bolt or other means, thus making the liquid crystal module 2 fixed to the pallet 3 into a whole; the liquid crystal module 2 is provided on all sides with a protective layer for buffering as well as auxiliary fixing of the liquid crystal module 2, with a packaging box of high strength arranged externally for protection.

Figure 1:
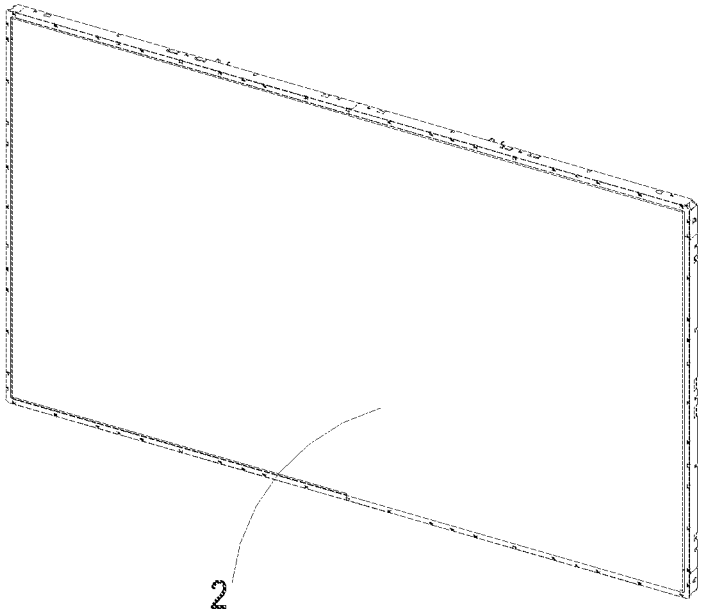
FIG. 1 is a schematic diagram of the liquid crystal module that is packaged according to the example of the packaging device for liquid crystal modules of the present invention.
Figure 2:
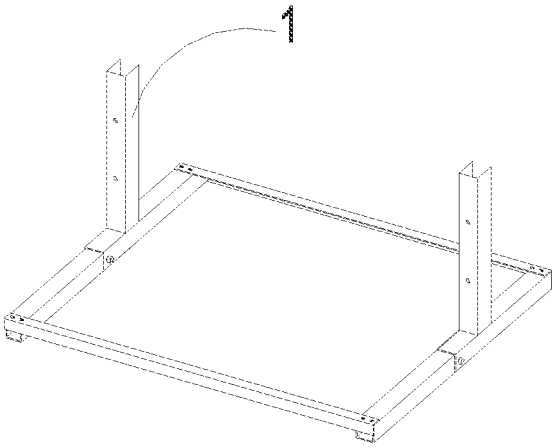
FIG. 2 is a schematic diagram of the bracket of the example of the packaging device for liquid crystal modules of the present invention.

Specifically, as shown in FIGS. 1 and 2, the bracket 1 is preferably an L-shaped bracket, which is lockingly fixed to the backboard or bottom side of the liquid crystal module 2 where the screw locking is allowed, thus facilitating manual transport of the liquid crystal module 2. Meanwhile, the liquid crystal module 2 and the bracket 1 are fixed to the pallet 3 carrying the liquid crystal module 2 into a whole through a bolt or other fixing means, with the bottom and lateral side as well as the top as the auxiliary buffer support, so as to minimize the amplitude and frequency of the vibration of the liquid crystal module 2 during the transport that is produced under the action of an external force, thus preventing the components and parts of the liquid crystal module 2 from being damaged caused by vibration during the transport.

Figure 3:
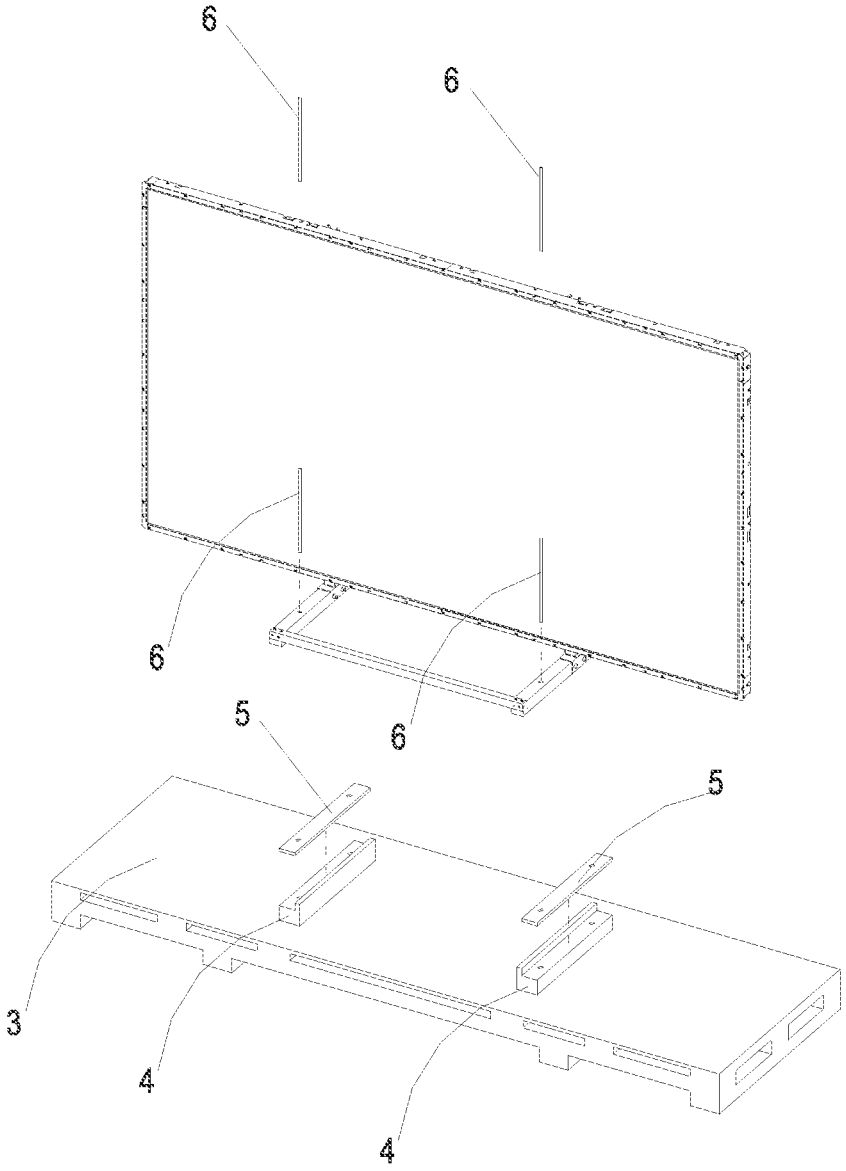
FIG. 3 is an exploded schematic diagram where the liquid crystal module as shown in FIG. 1 is fixed on the pallet of the example of the packaging device for liquid crystal modules of the present invention.
Figure 4:
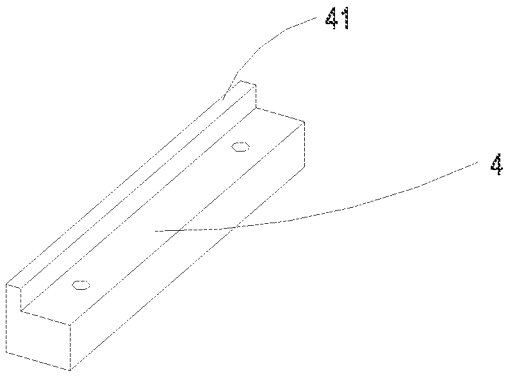
FIG. 4 is a schematic diagram of the supporting member of the example of the packaging device for liquid crystal modules of the present invention.
Figure 5:
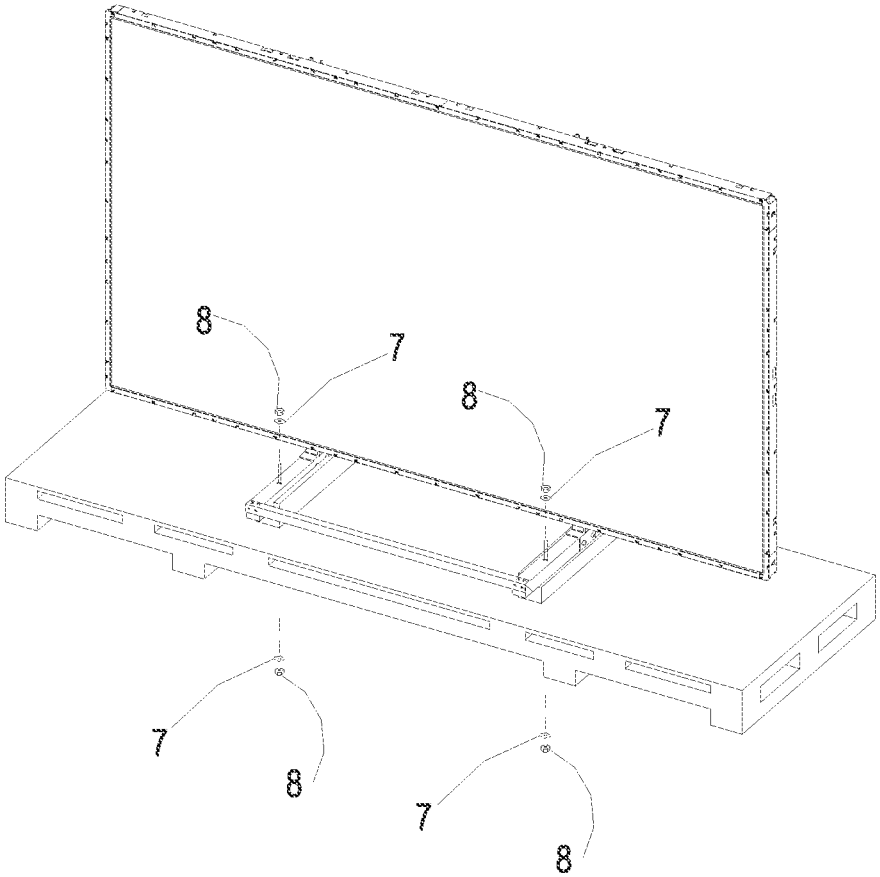
FIG. 5 is an assembly schematic diagram where the liquid crystal module shown in FIG. 1 is fixed on the pallet of the example of the packaging device for liquid crystal modules of the present invention.

As shown in FIGS. 3-5, the bracket 1 is fixed to the pallet 3 through the bolt 6. That is, the liquid crystal module 2 and the L-shaped bracket 1 are positioned and fixed to the supporting member 4 of the pallet 3, with the bolt 6 going through the L-shaped bracket 1, the supporting member 4 on the pallet 2 and the pallet surface. Then the L-shaped bracket 1 is fixed integrally to the pallet 3 through the nut 8, and a plurality of gaskets 7 are added for making the nut 8 fixed to the bolt 6 more tightly. Meanwhile, the supporting member 4 for buffering and positioning is further provided with the buffer gasket 5 attached to the supporting member 4, with the supporting member 4 including the bulge 41 for positioning the bracket 1.

Figure 6:
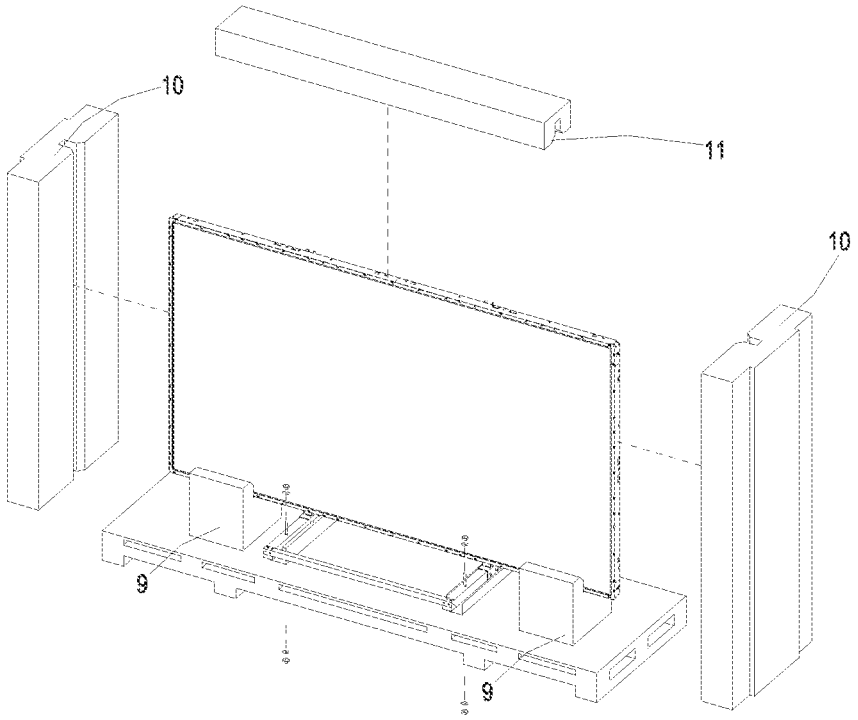
FIG. 6 is a schematic diagram of the protective layer of the example of the packaging device for liquid crystal modules of the present invention.

As shown in FIG. 6, the protective layer includes the lower foaming buffer layer 9 that is arranged at the bottom of the liquid crystal module 2 and has a shock-absorption buffering effect, a lateral foaming buffer layer 10 that is arranged at both sides of the liquid crystal module 2 for auxiliary fixing of the liquid crystal module 2 and the outer packaging box, and an upper foaming buffer layer 11 arranged at the top of the liquid crystal module 2.

Figure 7:
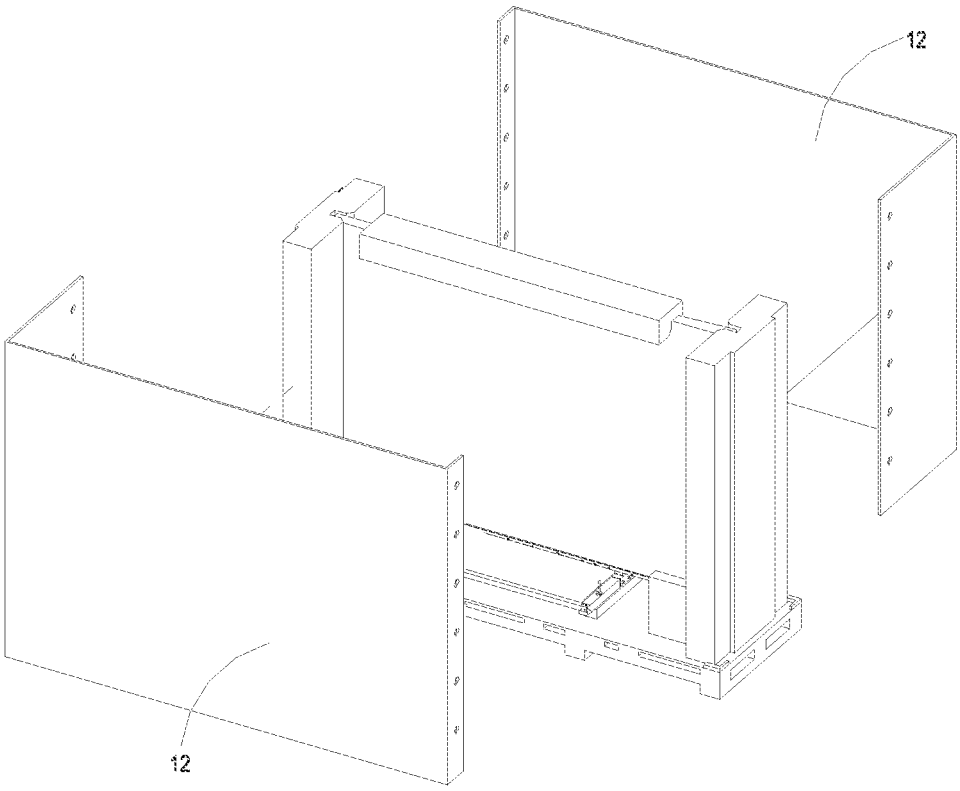
FIG. 7 is a schematic diagram of the outer carton of the example of the packaging device for liquid crystal modules of the present invention.
Figure 8:
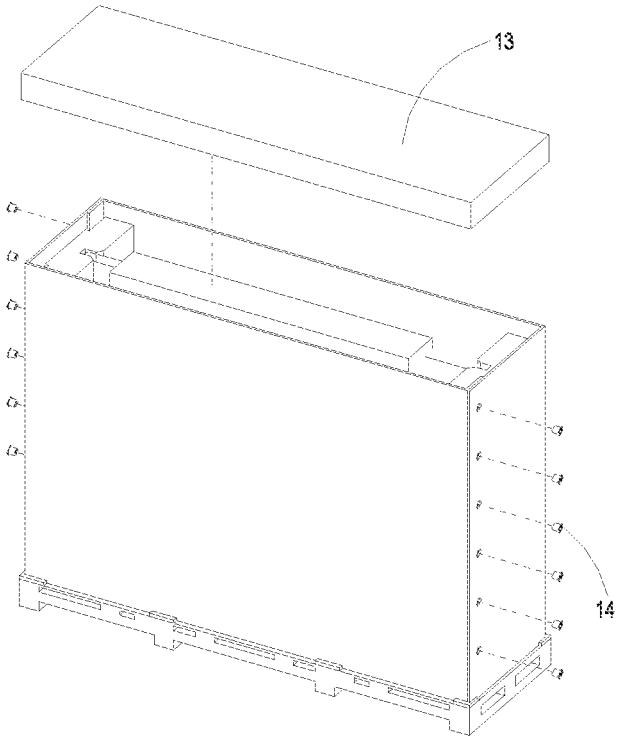
FIG. 8 is a schematic diagram of the top carton of the example of the packaging device for liquid crystal modules of the present invention.

As shown in FIGS. 7-8, the packaging box includes two pieces of outer cartons 12 spliced together and a top carton 13 closely covering their top; the two pieces of outer cartons 12 are fixed together through a lock catch 14, with the top carton 13 finally covering on their top to form a whole. Wherein the packaging box is preferably made of corrugated paper, such as the 3A high-strength corrugated paper.

Figure 9:
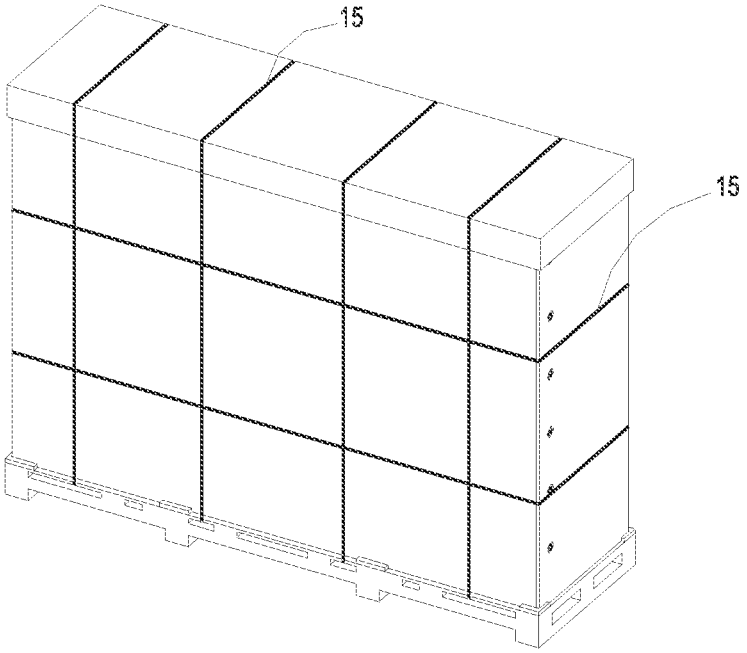
FIG. 9 is a schematic diagram of packaging according to the example of the packaging device for liquid crystal modules of the present invention.

As shown in FIG. 9, the packaging box and the pallet 3 are fixed together through the packaging belt 15 to form a whole, with the packaging belt 15 packaging vertically and horizontally respectively to further make them firmer, wherein the packaging belt 15 is preferably made of PET material having a large tension.

The packaging device for large-sized liquid crystal modules of the present invention can guarantee transport safety, facilitate manual packaging and transporting, and reduce packaging weight of the large-sized liquid crystal module.

The above disclosure only contains the preferred examples of the present invention, and those skilled in the art know that various changes or equivalent replacement can be made to these features and examples without departing from the spirit and scope of the present invention. Besides, under the guidance of the present invention, these features and examples can be amended to adapt to specific circumstances and materials without departing from the spirit and scope of the present invention. Therefore, the present invention is free from restriction of the specific examples disclosed here, and all the examples falling within the scope of the claims of this application all fall within the scope of protection of the present invention.

The invention claimed is:

1. A packaging device for a liquid crystal module, comprising a bracket used for holding and fixing the liquid crystal module, a pallet used for holding and fixing the bracket via a supporting member, a buffer gasket for buffering, a protective layer for fixing and buffering the liquid module, and a packaging box arranged outside the protective layer for packaging;

wherein the supporting member for buffering and positioning includes a bulge and a mounting base which are parallel to each other in a longitudinal direction, the bulge is used for positioning the bracket and the buffer gasket, and the mounting base is used for mounting the bracket;

wherein the buffer gasket is arranged between the bracket and the mounting base; and wherein mounting holes aligned with each other are respectively defined on the bracket, the buffer gasket, the mounting base and the pallet, and a bolt fit with the mounting holes is used to connecting together the bracket, the buffer gasket, the mounting base and the pallet from top to bottom.

2. The packaging device for liquid crystal modules according to claim 1, wherein the bracket is an L-shaped bracket.

3. The packaging device for liquid crystal modules according to claim 1, wherein the protective layer includes a lower foaming buffer layer arranged at the bottom of the liquid crystal module, a lateral foaming buffer layer arranged at both sides of the liquid crystal module, and an upper foaming buffer layer arranged at the top of the liquid crystal module.

4. The packaging device for liquid crystal modules according to claim 1, wherein the packaging box is made of corrugated paper.

5. The packaging device for liquid crystal modules according to claim 4, wherein the packaging box includes two pieces of outer cartons spliced together and a top carton closely covering their top.

6. The packaging device for liquid crystal modules according to claim 5, wherein the packaging device for liquid crystal modules further includes a lock catch for fixing the two pieces of outer cartons together, and a plurality of packaging belts for fixing the packaging box to the pallet.

7. A packaging device for a liquid crystal module, comprising an L-shaped bracket used for holding and fixing the liquid crystal module, a pallet used for holding and fixing the bracket via a supporting member, a buffer gasket for buffering, a protective layer for fixing and buffering the liquid module, a packaging box arranged outside the protective layer for packaging the same, and a plurality of packaging belts for fixing the packaging box to the pallet;

wherein the protective layer includes a lower foaming buffer layer, a lateral foaming buffer layer, and an upper foaming buffer layer, which are used for surrounding the liquid crystal module;

wherein the supporting member for buffering and positioning includes a bulge and a mounting base which are parallel to each other in a longitudinal direction, the bulge is used for positioning the bracket and the buffer gasket, and the mounting base is used for mounting the bracket;

wherein the buffer gasket is arranged between the bracket and the mounting base; and wherein mounting holes aligned with each other are respectively defined on the bracket, the buffer gasket, the mounting base and the pallet, and a bolt fit with the mounting holes is used to connecting together the bracket, the buffer gasket, the mounting base and the pallet from top to bottom.

8. The packaging device for liquid crystal modules according to claim 7, wherein the packaging box is made of 3A high-strength corrugated paper.

9. The packaging device for liquid crystal modules according to claim 8, wherein the packaging box includes two pieces of outer cartons spliced together and a top carton closely covering their top.

10. The packaging device for liquid crystal modules according to claim 9, wherein the packaging device for liquid crystal modules further includes a lock catch for fixing the two pieces of outer cartons together.

* * * * *